United States Patent [19]

Weiler et al.

[11] 4,013,374

[45] Mar. 22, 1977

[54] COVER FOR MANHOLE STRUCTURES

[75] Inventors: Walter K. F. Weiler, Diez; Rudolf C. Passavant, Aarbergen, both of Germany

[73] Assignee: Passavant-Werke Michelbacher Hutte, Germany

[22] Filed: Oct. 16, 1975

[21] Appl. No.: 622,909

[52] U.S. Cl. ..... 404/25

[51] Int. Cl.[2] ..... E02D 29/08

[58] Field of Search ..... 404/25, 26; 52/19, 20, 52/21, 23; 49/436

[56] References Cited

UNITED STATES PATENTS

| | | | |
|---|---|---|---|
| 680,287 | 8/1901 | Steele | 404/25 |
| 681,995 | 9/1901 | Steele | 404/25 |
| 1,689,646 | 10/1928 | Tutsch | 404/25 |
| 3,289,556 | 12/1966 | Russell | 404/25 |

*Primary Examiner*—Henry S. Jaudon
*Attorney, Agent, or Firm*—Woodford R. Thompson, Jr.

[57] ABSTRACT

A cover for manhole structures embodying a metal portion constructed of high strength material and assembled to provide maximum strength with a minimum of weight. A concrete portion is carried by the metal portion with the weight of the concrete portion being so proportioned relative to the weight of the metal portion that the combined weight thereof provides a manhole cover of a predetermined minimum weight.

7 Claims, 3 Drawing Figures

COVER FOR MANHOLE STRUCTURES

BACKGROUND OF THE INVENTION

This invention relates to a cover for a manhole structure and more particularly to such a cover which requires a minimum of metal to provide the required strength with the overall weight of the composite cover being of a predetermined minimum weight.

As is well known in the art to which our invention relates, manhole covers are exposed to heavy traffic and must be of a certain minimum weight or else must be secured to the manhole frames by suitable securing means in order to prevent them from becoming dislodged by vehicles passing thereover. Heretofore, this required minimum weight of the manhole cover has been attained by the use of conventional cast iron supporting structures. Now that it is possible to reduce the weight of manhole covers by the use of high strength materials and improved designs, the weight of such covers are often considerably below the minimum weight required to hold the same in place without additional securing means.

SUMMARY OF THE INVENTION

In accordance with our invention, we provide a cover for manhole structures which provides all of the advantages of a cast iron supporting structure with a requirement of less metal while still providing a cover which is heavy enough to permit its insertion in a manhole frame without the use of fastening means. Our improved manhole cover is provided by an improved design of the metal portion thereof and the use of high strength materials whereby the amount of metal is reduced to a minimum, while the weight of a concrete portion of the cover is so selected that together with the weight of the metal portion it will at least add up to the required minimum weight. Accordingly, by designing the metal portion whereby it absorbs the full traffic load, the concrete portion may be constructed as a non-supporting component for the purpose of adding weight only.

DESCRIPTION OF THE DRAWINGS

A cover for manhole structures embodying features of our invention is illustrated in the accompanying drawings, forming a part of this application, in which.

DETAILED DESCRIPTION

Figure 1:
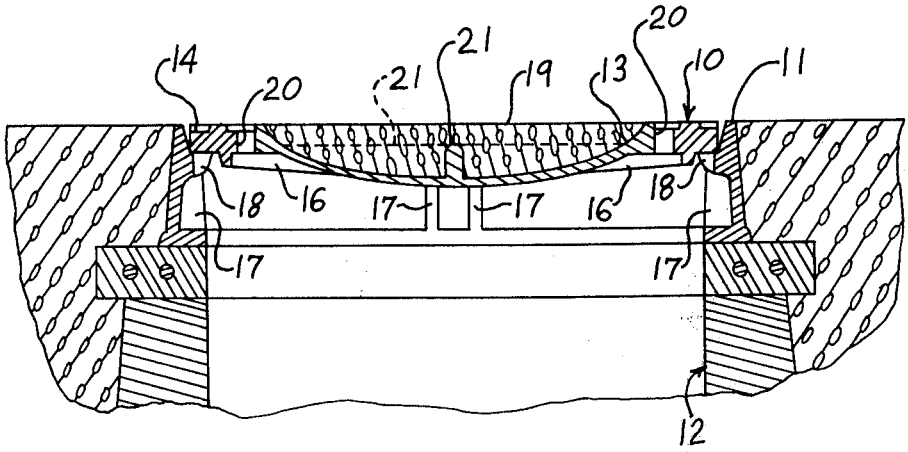
FIG. 1 is a vertical sectional view, partly broken away, showing one form of our invention with the manhole cover mounted in a supporting frame.

Referring now to the drawings for a better understanding of our invention, we show a manhole cover 10 which is mounted in a suitable supporting frame 11 which defines the upper end of a manhole assembly indicated generally at 12. As shown in FIG. 1, the cover 10 comprises a cast iron supporting structure which is of an extremely light-weight construction so as to save material. This structure is made possible due to the improved high-strength design and the characteristics of the material used, such as spheroidal graphite iron. The cast iron support structure is shown as comprising an upwardly opening, tub-shaped member 13 which is formed integrally with an annular peripheral member 14. Radially extending reinforcing ribs 16 extend between the annular member 14 and the lower side of the tub-shaped member 13, as shown. Also, suitable vent openings 20 may be provided in the cover 10, as shown. The under surface of the peripheral edge of the annular member 14 engages and is supported by arcuate support members 18 which are carried by the support structure 11. As shown in FIG. 1, the support structure 11 may be provided with spaced apart vertical members 17.

The upwardly opening, tub-like member 13 supports a concrete filling 19 which comprises a heavy concrete having a specific gravity which is greater than the specific gravity of conventional concrete compositions. Accordingly, the weight of the concrete filling 19 compensates for a weight deficiency of the cast iron supporting structure for the manhole cover 10 without offsetting the material costs saved by the use of a light-weight metal structure. As shown in FIG. 1, transverse cross members 21 may be formed within the tub-like member 13 to reinforce the cover and also to retain the concrete filling 19 in place.

The weight loss resulting from the reduction of material used for the cast iron supporting structure 10 is thus compensated for by the use of the concrete filling 19 which contains extra heavy aggregates. The cost of production of such concrete is more than offset by the material cost saved in the production of a light-weight cast iron supporting structure. Accordingly, our improved manhole cover is much less expensive and at the same time meets the minimum weight requirements for holding the cover in place during use.

The heavy aggregates in the concrete filling 19 may comprise shredded cast iron scrap, red iron ore, barium sulfate and the like. Such materials have a sufficiently high specific gravity to provide the total weight required for the manhole cover. Furthermore, such materials pose no problems concerning thermal expansion since these aggregates agree in this respect with the remaining constituents of the concrete filling 19 and the metal supporting structure 10. The aggregates may be used separately or combined with each other with the selection depending upon the cost of the various aggregates at the construction site. Preferably, the amount of aggregates used should be so related to their specific gravity that the specific gravity of the concrete filling will amount to 4–6 kg/dm$^3$. That is, the concrete thus produced ranges from two to three times the specific gravity of ordinary concrete. The concrete filling 19 may be made with an aggregate such as a mixture of cast iron scrap and barium sulfate with the specific weight of the barium sulfate being 4.3 and that of the cast iron being 7.2 so as to produce a concrete having a specific weight of 5 kg/dm$^3$. Accordingly, the specific weight of the material used to make the cover will exceed a required minimum weight to 300 kg/m$^2$.

Figure 3:
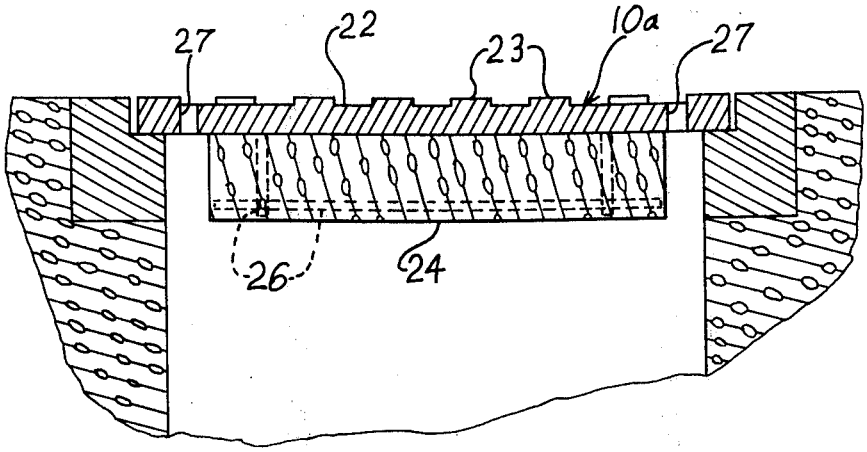
Figure 2:
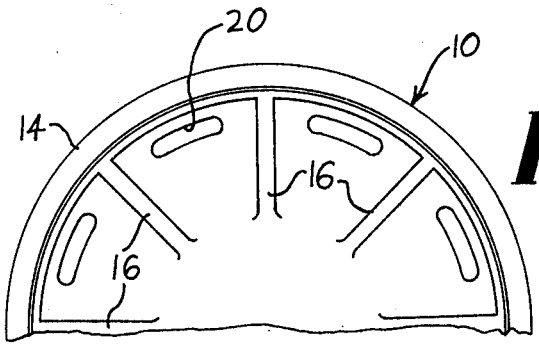
FIG. 2 is a fragmental, bottom plan view of the manhole cover shown in FIG. 1 showing a portion of the manhole cover removed from the supporting frame for the manhole cover; and, FIG. 3 is a vertical sectional view showing another embodiment of our invention and showing a portion of the manhole assembly which surrounds the supporting frame for the manhole cover.

Referring now to FIG. 2 of the drawings, we show a manhole comprising a supporting structure 10$^a$ made of high-tensile strength material. The supporting structure 10$^a$ is shown as being in the form of a relatively flat plate-like member 22 with the upper surface thereof being provided with anti-skid knobs 23 or similar protuberances. The lower surface of the plate-like member 22 supports a concrete slab 24 which is secured to the plate-like member 22 by suitable anchoring means, such as suitable reinforcing bars 26 which may be formed of iron. Since the concrete slab 24 depends from the plate-like member 22, it performs no supporting function whereby it serves only to increase the weight of the cover. It will be understood that in this embodiment the concrete also contains heavy aggregates so as to maintain the dimensions of the concrete slab 24 within the necessary limits. As shown in FIG. 3, the concrete slab 24 is of a width to be positioned inwardly of vent openings 27 carried by the plate-like member 22.

From the foregoing it will be seen that we have provided an improved cover for manhole structures which provides all of the advantages of a cast iron supporting structure while reducing the amount of metal materials employed and still providing a cover which is heavy enough to permit its insertion in manhole frames without the use of fastening means.

While we have shown our invention in two forms, it will be obvious to those skilled in the art that it is not so limited, but is susceptible of various other changes and modifications without departing from the spirit thereof.

What we claim is:

1. In a cover for manhole structures, a. a metal portion constructed and arranged of high strength material providing maximum strength with a minimum of weight, and b. a concrete portion carried by said metal portion with the specific gravity of said concrete portion exceeding the specific gravity of conventional concrete and being so proportioned relative to the weight of said metal portion that the combined weights of said metal portion and said concrete portion provide a manhole cover of a predetermined minimum weight.

2. A cover as defined in claim 1 in which said concrete portion is a non-supporting element.

3. A cover as defined in claim 1 in which said concrete portion has heavy aggregates therein.

4. A cover as defined in claim 3 in which said heavy aggregates comprise a metal compound selected from the group consisting of cast iron, iron ore, barium sulfate and mixtures thereof.

5. A cover as defined in claim 1 in which said metal portion is an upwardly opening tub-shaped structure with its cavity filled with concrete having heavy aggregates therein.

6. A cover as defined in claim 5 in which said tub-shaped structure carries transverse iron members and an annular seating member which surrounds said tub-shaped structure.

7. In a cover for manhole structures, a. a generally flat metal plate constructed and arranged of high strength material providing maximum strength with a minimum of weight, and b. a non-supporting concrete portion secured to the under surface of said metal plate with the weight of said concrete portion being so proportioned relative to the weight of said metal plate that the combined weights of said metal plate and said concrete portion provide a manhole cover of a predetermined minimum weight.

* * * * *